US006786376B1

(12) United States Patent
Pitzen et al.

(10) Patent No.: US 6,786,376 B1
(45) Date of Patent: Sep. 7, 2004

(54) ROLLED SHEET MATERIAL DISPENSER WITH PROTECTED SHEET CUTTING MEANS

(75) Inventors: James F. Pitzen, Maplewood, MN (US); Ronald C. Johansson, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/571,590

(22) Filed: May 17, 2000

(51) Int. Cl.[7] ..... B26F 3/02
(52) U.S. Cl. ..... 225/19; 225/56; 225/77
(58) Field of Search ..... 225/19, 20, 48, 225/56, 77, 91, 93; 83/568, 570, 649; 242/522, 523.1, 526, 554.2

(56) References Cited

U.S. PATENT DOCUMENTS

| | | | | | |
|---|---|---|---|---|---|
| 2,125,736 | A | | 8/1938 | Murray | |
| 2,229,961 | A | * | 1/1941 | Deane | 225/19 |
| 3,227,340 | A | * | 1/1966 | Haley | 225/19 |
| 3,419,201 | A | * | 12/1968 | Brandon | 83/649 |
| 3,552,614 | A | * | 1/1971 | Wilson et al. | 225/20 |
| 3,565,307 | A | * | 2/1971 | Wiley et al. | 225/19 |
| 3,739,964 | A | * | 6/1973 | Stine | 225/53 |
| 4,651,911 | A | * | 3/1987 | Kirkup et al. | 225/20 |
| 4,781,316 | A | * | 11/1988 | Freeberg | 225/91 |
| 4,972,984 | A | * | 11/1990 | Frank et al. | 225/20 |
| 4,989,769 | A | * | 2/1991 | Longworth et al. | 225/20 |
| 5,054,675 | A | * | 10/1991 | Taves | 225/20 |
| 5,222,644 | A | * | 6/1993 | Moreno | 225/19 |
| 5,383,590 | A | * | 1/1995 | Ho | 225/87 |
| 5,928,466 | A | | 7/1999 | Yu Chen | |
| 6,039,102 | A | * | 3/2000 | Sadrakula et al. | 225/20 |
| 6,296,033 | B1 | * | 10/2001 | Clements | 225/19 |

FOREIGN PATENT DOCUMENTS

| | | |
|---|---|---|
| EP | 0 714 845 A1 | 6/1996 |

* cited by examiner

*Primary Examiner*—Stephen Choi
(74) *Attorney, Agent, or Firm*—William L. Huebsch

(57) ABSTRACT

A dispenser from which sheet material may be dispensed from a supply of the sheet material carried on the dispenser. The dispenser has a frame on which the roll of sheet material is journaled for rotation about its axis. An elongate blade fixed to the frame has a sharp cutting edge that is adapted for transversely cutting the sheet material after a desired length of the sheet material has been dispensed. A guard strip of resiliently movable material extends along one major surface of the blade and along the cutting edge to help protect the sheet material and/or users of the dispenser from the cutting edge. That guard strip is resiliently movable by pulling the sheet material toward the cutting edge to allow the cutting edge to transversely sever the sheet material being pulled from the dispenser.

4 Claims, 6 Drawing Sheets

ROLLED SHEET MATERIAL DISPENSER WITH PROTECTED SHEET CUTTING MEANS

FIELD OF THE INVENTION

The present invention relates to dispensers from which lengths of sheet material may be manually dispensed from supplies of the sheet materials carried on the dispensers, which dispensers include cutting members having sharp cutting edges adapted for transversely cutting dispensed lengths of the sheet materials from the supplies of sheet materials remaining on the dispensers, and include means for protecting users of the dispensers from the cutting members.

DESCRIPTION OF THE RELATED ART

The art is replete with dispensers from which lengths of sheet materials may be manually dispensed from supplies of the sheet materials (typically from rolls of the sheet material) that are carried on the dispensers, which dispensers include cutting members having cutting edges adapted for transversely cutting dispensed lengths of the sheet materials from the supplies of sheet materials remaining on the dispensers, and which dispensers include means for protecting users of the dispensers from the cutting members. U.S. Pat. Nos. 2,229,961; 4,989,769 describing a guard for a cutting blade adapted to cut folded polymeric sheet material described in U.S. Pat. No. 4,913,767; U.S. patent application Ser. No. 08/855,687 filed May 14, 1997, (International Publication Number WO 98/51603); and U.S. patent application Ser. No. 09/052,400 filed Mar. 31, 1998, (International Publication Number WO 99/49804) provide illustrative examples.

SUMMARY OF THE INVENTION

The present invention provides a dispenser from which lengths of a sheet material may be dispensed from a supply of the sheet material carried on the dispenser, which dispenser includes means for providing a cutting edge adapted for transversely cutting a dispensed length of the sheet material from the supply of sheet material remaining on the dispenser, and which dispenser includes means for protecting users of the dispenser from a cutting edge which is either less expensive, more effective for the intended use, or simpler to use than such means that have been provided on known prior art dispensers.

In the dispenser according to the present invention the means for providing the cutting edge is an elongate blade having the sharp cutting edge along a first elongate edge, which blade is fixed to a frame of the dispenser, and the means for protecting users of the dispenser from the cutting edge comprises a guard strip of resiliently moveable (i.e., compressible or flexible) material attached adjacent or along one major surface of the blade. That guard strip of resiliently moveable material has a contact surface normally extending along the sharp cutting edge to protect users of the dispenser from the cutting edge, which contact surface can be resiliently moved by pulling the side of the sheet material toward the cutting edge, thereby allowing the cutting edge to transversely sever the sheet material being pulled from the roll.

The blade can include generally triangular teeth along its first edge with the cutting edge being along the teeth, and the guard strip of resiliently moveable material should not be attached to the blade along the teeth to allow it to be easily moved (e.g., compressed or flexed) when the sheet material is pulled toward the cutting edge to transversely sever the sheet material being dispensed.

In one embodiment described herein the dispenser is portable and dispenses sheet material from a roll of the sheet material. The frame of the dispenser includes a bridging portion adapted to extend axially along a portion of the periphery of the roll, and further includes end wall portions fixed to the ends of the bridging portion that are adapted to extend along opposite end surfaces of the roll of sheet material and on which are means for journaling the roll of sheet material for rotation about its axis. The blade is fixed to the bridging portion of the frame adjacent one edge with the cutting edge adjacent the axis about which the roll rotates and with the major surface of the blade adjacent a major part of the bridging portion disposed at an angle of more than about 110 degrees (e.g., preferably about 135 degrees) with respect to a plane passing through that axis and generally through the cutting edge to restrict contact between a person using the dispenser and the cutting edge. The guard strip of resiliently moveable material extends along the major surface of the blade that is adjacent the major part of the bridging portion. The contact surface of the guard strip restricts contact between sheet material being pulled from the roll and the cutting edge, but can be resiliently moved by pulling the side of the sheet material toward the cutting edge to allow the cutting edge to transversely sever the sheet material being pulled from the roll. The guard strip also helps restrict contact between a person using the dispenser and the cutting edge when the roll of sheet material becomes sufficiently small in diameter that a user can put his or her fingers between the roll and the cutting edge.

In another embodiment described herein the dispenser is a modification of the portable dispenser described in U.S. Pat. No. 4,990,214 that forms the sheet material dispensed from two rolls of material carried on the dispenser (e.g., a roll of longitudinally folded polymeric film and a roll of adhesive coated tape that is applied along one edge of the film with a portion of the tape projecting past the edge of the film by which the dispensed sheet material may be adhered to a surface for the purpose of masking during painting). The sharp cutting edge on the blade for that dispenser is spaced from the path along which sheet material is pulled from the dispenser and is positioned where it can be inadvertently contacted by a careless user of the dispenser. The guard strip of resiliently compressible material attached along the blade can be sequentially compressed along its length to afford sequential transverse cutting of the sheet material on the cutting edge, while providing significant resistance to compression when thus contacted by the relatively wide surfaces of a users fingers or hand to thereby restrict seriously injurious contact with the cutting edge of the blade.

BRIEF DESCRIPTION OF THE DRAWINGS

The present invention will be further described with reference to the accompanying drawing wherein like reference numerals refer to like parts in the several views, and wherein:

FIGS. 3 and 4 are sectional views of the dispenser of FIG. 2 taken approximately along line 3—3 of FIG. 2 in which FIG. 3 illustrates the sheet material being pulled from the dispenser, and FIG. 4 illustrates the sheet material being cut on the cutting edge;

FIGS. 6 and 7 are enlarged fragmentary views of the dispenser of FIG. 5 in which FIG. 6 illustrates the sheet material being pulled from the dispenser, and FIG. 7 illustrates the sheet material being cut on the cutting edge;

DETAILED DESCRIPTION

Figure 1:
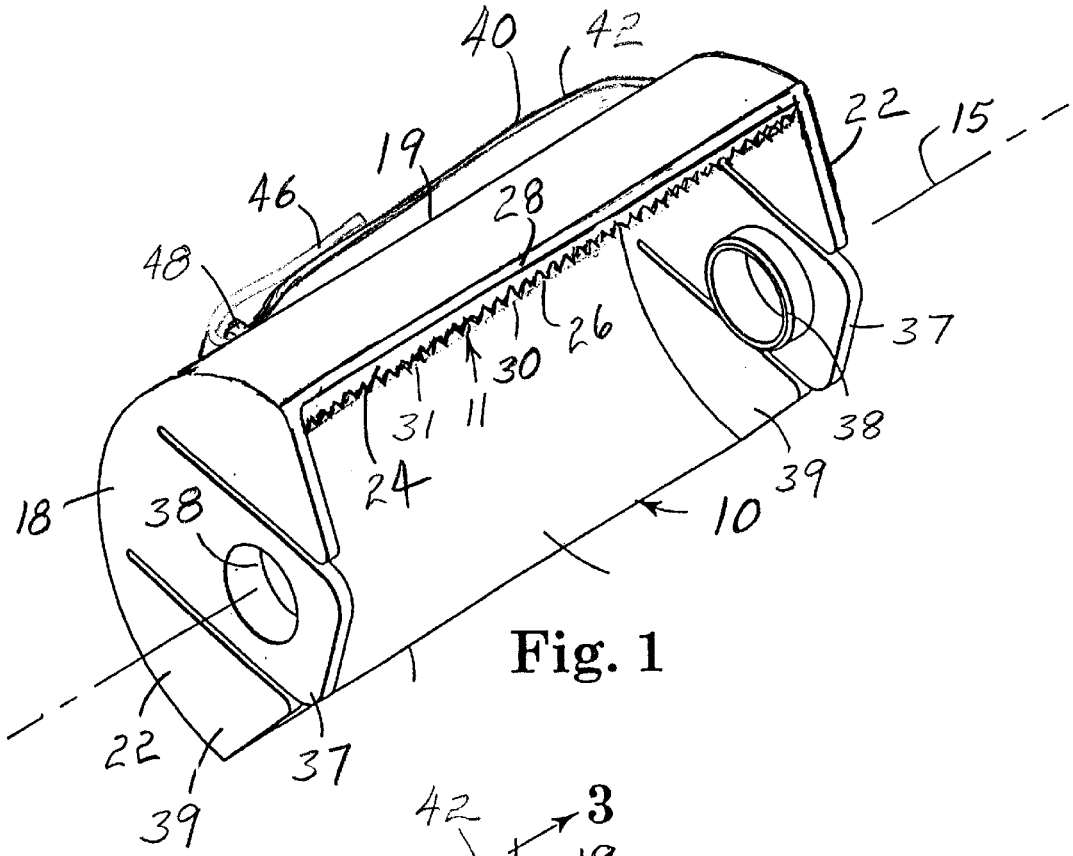
FIG. 1 is a perspective view of a first embodiment of a dispenser including means according to the present invention for protecting users of the dispenser from a cutting edge.
Figure 2:
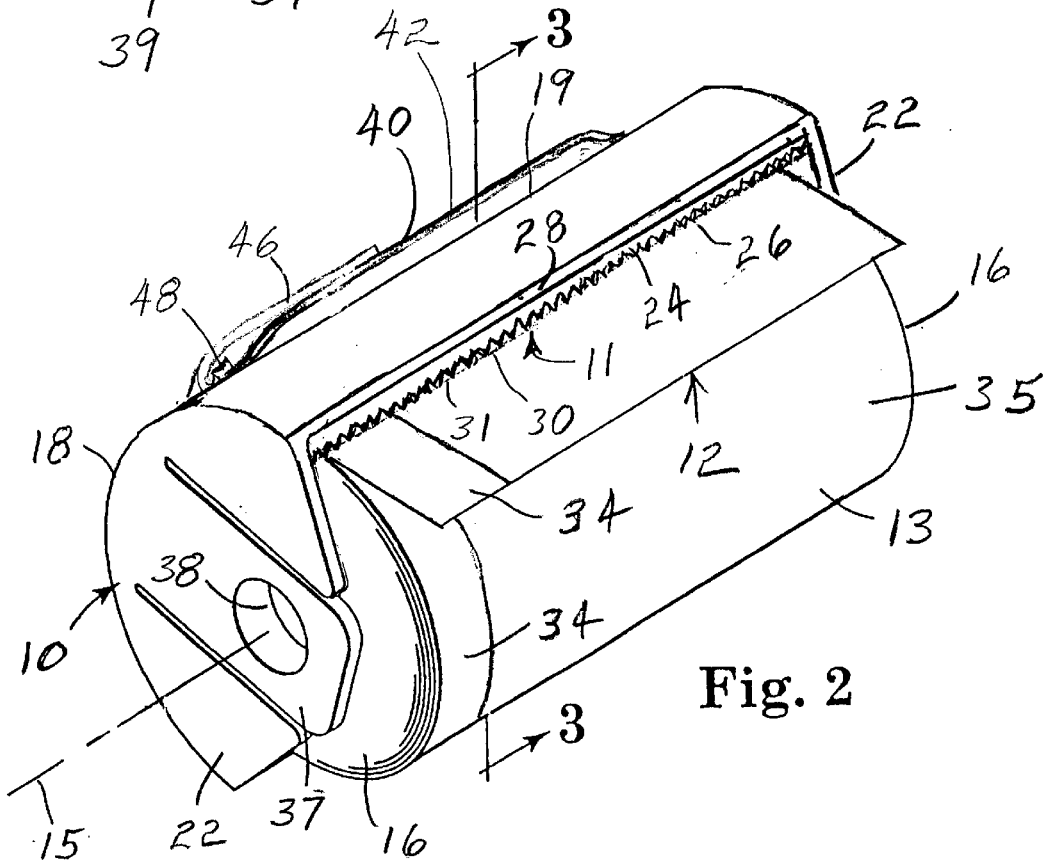
FIG. 2 is a perspective view of the dispenser of FIG. 1 in which is journaled a roll of sheet material to be dispensed.
Figure 3:
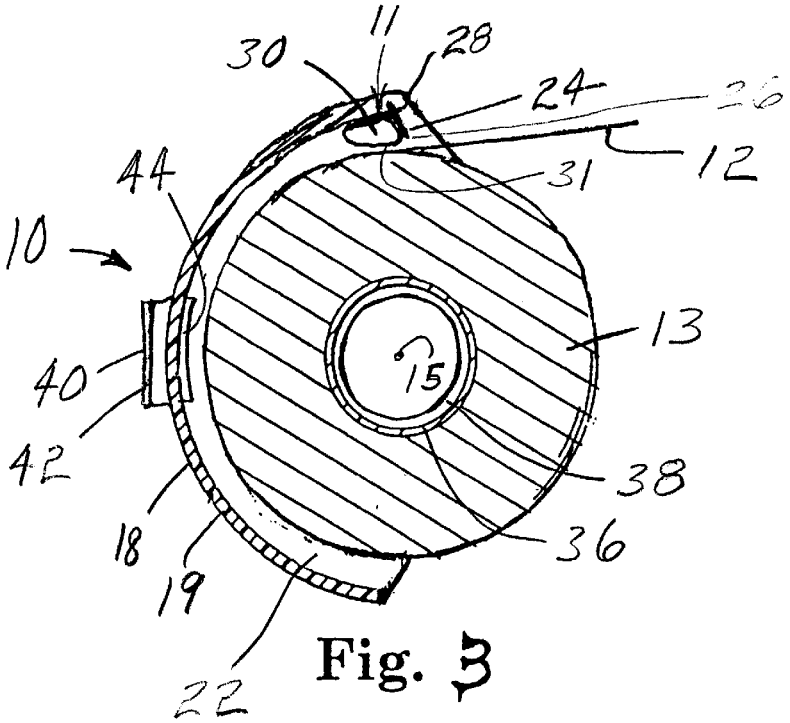

Referring now to FIGS. 1 through 4 of the drawing, there is shown a dispenser 10 including means 11 according to the present invention for protecting users of the dispenser from a cutting edge 26.

The dispenser 10 is portable and of the type from which sheet material 12 may be manually dispensed or pulled from a roll 13 of the sheet material 12 carried on the dispenser 10 (see FIGS. 2, 3, and 4), which roll 13 has a generally cylindrical periphery about an axis 15 and has axially spaced end surfaces 16. The dispenser 10 comprises a frame 18 of polymeric material (e.g., an ABS resin) including a bridging portion 19 having opposite ends, which bridging portion 19 is arcuate or semi-cylindrical and is thereby adapted to extend along a portion of the periphery of the roll 13 with its ends positioned at the end surfaces 16 of the roll. The frame 18 further includes two end wall portions 22 fixed to the ends of the bridging portion 19 and adapted to project at generally a right angle thereto along the opposite end surfaces 16 of the roll 13 of sheet material 12. Means (later to be explained) on those end wall portions 22 are adapted for journaling the roll 13 of sheet material 12 for rotation about its axis 15 with the end surfaces 16 of the roll 13 adjacent the end wall portions 22 and the bridging portion 19 extending along the periphery of the roll 13.

The dispenser 10 includes an elongate blade 24 having opposite major surfaces extending between opposite elongate edges, and the sharp cutting edge 26 defined along the distal edges of projecting teeth along one of its elongate edges, which cutting edge 26 is adapted for transversely cutting the sheet material 12. The blade 24 is fixed to the bridging portion 19 of the frame 18 along an edge 28 of the bridging portion 19 extending between its ends generally parallel to the axis 15. The blade 24 is attached with its cutting edge 26 adjacent the axis 15 and with the major surface of the blade 24 adjacent a major part of the bridging portion 19 disposed at an angle of more than about 110 degrees (e.g., preferably about 135 degrees) with respect to an imaginary plane passing through the axis 15 and generally through the cutting edge 26 to restrict contact between a person using the dispenser 10 and the cutting edge 26 (i.e., by generally through the cutting edge 26 we mean through the cutting edge if it is straight, or through the outermost portions of the cutting edge when, as described above, the cutting edge 26 is defined along the distal edges of projecting teeth). The dispenser 10 also includes a guard strip 30 of resiliently moveable or compressible material (e.g., of urethane foam) extending along the major surface of the blade 24 adjacent the major part of the bridging portion 19. A contact surface 31 of the guard strip 30 is positioned along the tips of the teeth to restrict contact between sheet material 12 being pulled from the roll 13 and the cutting edge 26. The contact surface 31 of the guard strip 30 can be resiliently moved by pulling the side of the sheet material 12 toward the cutting edge 26 to compress the guard strip 30, thereby allowing the cutting edge 26 to transversely sever the sheet material 12 being pulled from the roll 13. Preferably, the contact surface 31 of the guard strip 30 normally extends to or just past the cutting edge 26 at the tips of the teeth, and the guard strip 30 is attached (e.g., by an adhesive) to the frame 18 rather than along the side of the blade 24 to facilitate compression of the guard strip 30 when the sheet material 12 is being cut on the blade 24.

The sheet material 12 in the roll 13 can be any flexible cuttable sheet material, or a composite of two or more such sheet materials. Such sheet material or materials include, but are not limited to, paper, thin metal, cloth, polymeric material (e.g., film, shrink film, woven or non-woven fibers) or combinations thereof (e.g., medical drapes), which sheet material or materials may or may not be coated with a material such as pressure sensitive adhesive (i.e., adhesive tape) or an abrasive (i.e., sandpaper), or both. The dispenser 10 is particularly adapted for use with sheet material 12 that, as illustrated, is a composite of adhesive coated tape 34 and longitudinally folded polymeric film 35 similar to that commercially available from Minnesota Mining and Manufacturing Company, St. Paul, Minn., under the trade designation "Readymask Pre-taped Film". Also, the dispenser 10 should work well to dispense adhesive coated tapes with heavy backings such as duct tapes or masking tapes. The sheet material 12 can, as illustrated, be wound on a hollow cylindrical core 36 which can project a short distance (e.g., about 0.1 inch or 0.25 cm) from both of the end surfaces 16 of the roll 13 of sheet material 12 to help insure that the entire width of the sheet material 12 can engage the cutting edge 26.

The cutting edge 26 on the blade 24 is provided along the plurality of similarly shaped triangular teeth, which teeth have bases aligned in a first direction longitudinally along the blade 24 parallel with the edge 28 of the bridging portion 19 with the points of the teeth projecting in the same direction with respect to that distal edge 28. Those teeth, which are similar to the teeth described in U.S. Pat. No. 4,913,767 (the content whereof is incorporated herein by reference), can pierce the sheet material 12 when the sheet material 12 is pulled into engagement with the cutting edge 26 (see FIG. 4) so that further tension applied on the sheet material 12 will cause the teeth to further penetrate the sheet material 12 as a result of tension being applied to withdraw the composite sheet material 12 until the sheet material 12 is completely severed by the cutting edge 26.

The means on the end wall portions 22 adapted for journaling the roll 13 of sheet material for rotation about its axis with the end surfaces 16 of the roll 13 adjacent the end wall portions 22 and the bridging portion 19 extending along the periphery of the roll 13 comprises flexible elongate parts 37 of the end walls 22 having opposed and axially aligned cylindrical collars 38 projecting toward each other along inner surfaces of the end walls 22. The cylindrical peripheries of the collars 38 are adapted to be received within and to journal the cylindrical inner surface of the hollow cylindrical core 36 about which the sheet material 12 is wound. Each of the flexible elongate parts 37 is attached to a primary part 39 of one of the end wall portions 22 only along one end. Each primary part 39 of each end wall portion 22 is quite rigid as it bridges across one end of the arcuate bridging portion 19, however, each of the elongate parts 37 is sufficiently flexible to allow them to be manually spread sufficiently to position the ends of the core 36 between the collars 38, while being sufficiently stiff to retain the collars 38 in the ends of core 36 to journal it when forces applied to spread the elongate parts 37 are released. As an example, an elongate part 37 of ABS resin 0.1 inch (0.25 cm) thick, 1.5 inch (3.8 cm) wide, and 1.2 inch (3 cm) long from the center of the collar 38 to its line of attachment to the primary part 39 will perform these functions.

As illustrated, a strap 40 extending generally parallel to the axis of the roll 13 along the outer surface of the bridging portion 19 of the frame 18 has its ends attached to the bridging portion 19 and has a central portion adjustably spaced from that bridging portion 19 so that a user of the dispenser 10 can insert his hand between the strap 40 and the bridging portion 19 with his fingers extending over the roll 13 to hold and operate the dispenser 10. A major portion 42 of the strap 40 is of the loop portion of commercially available hook and loop fastener material (e.g., the nylon hook and loop fastener material commercially available from Minnesota Mining and Manufacturing Company, St. Paul, Minn. under the trade designation "Scotchmate" (trademark) fastener). One end of that major portion 42 is attached to the bridging portion 19 by passing through a slot in the bridging portion 19 and having a loop 44 formed on its end along the inner surface of the bridging portion 19 that can not pass through that slot. A length 46 of the hook portion of that hook and loop fastener material is attached at the end of the major portion 42 opposite the loop 44. The strap 40 passes through a slot under a raised boss 48 on the bridging portion and around that boss 48 so that the length 46 of hook portion can be releasably attached along the loops on the major portion 42. That point of attachment can be selected to provide a desired space between the strap 40 and the outer surface of the bridging portion 19 for receiving a users hand.

Use of the Dispenser 10

To use the dispenser 10 (assuming the core 36 in the roll 13 of sheet material 12 is journaled on the cylindrical collars 38 projecting toward each from the end walls 22), a user can simply hold the dispenser 10 along its outer surface with one hand inserted between the strap 40 and the bridging portion 19 with the users fingers extending over the roll 13, and pull the sheet material 12 from the roll 13 with his or her other hand. Contact between the user and the cutting edge 26 on the teeth is restricted because the ends of the teeth are directed inwardly toward the roll 13 and (after sufficient sheet material 12 is removed from the roll 13 that there is sufficient space between the roll 13 and the cutting edge 26 for the users fingers) because the contact surface 31 of the guard strip 30 projects about to or even past the tips of the teeth. Also, contact between the sheet material 12 being pulled from the dispenser 10 and the teeth is restricted because the contact surface 31 of the guard strip 30 projects about to or even past the tips of the teeth (see FIG. 3).

Figure 4:
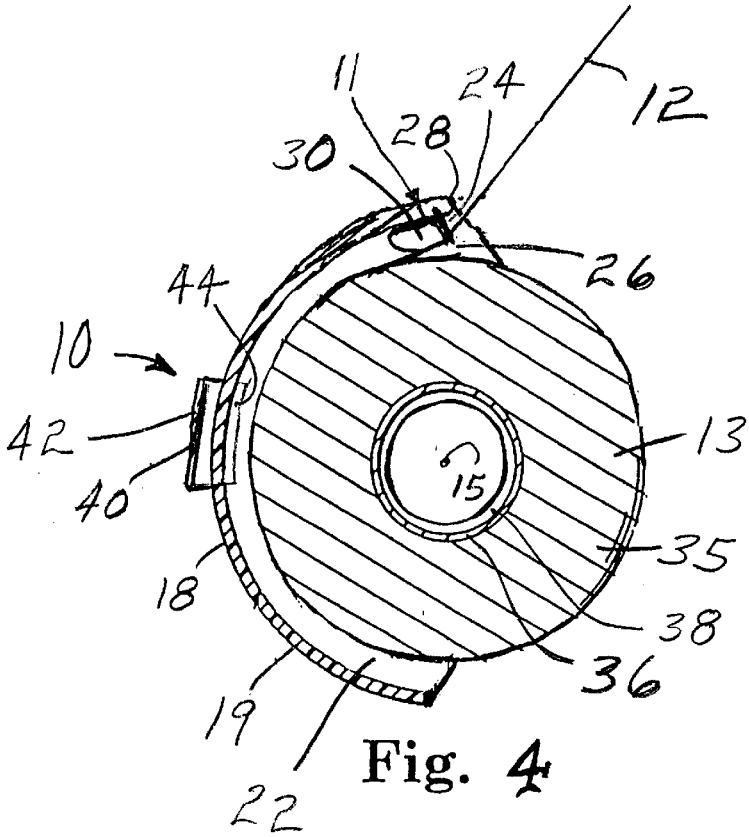

When the user has pulled a desired length of the sheet material 12 from the roll 13, the user presses his or her fingers against the roll 13 to stop its rotation, and pulls the dispensed length of sheet material 12 toward the cutting edge 26, thereby causing the sheet material 12 to sequentially incrementally compress the guard strip 30 along its length so that the sheet material 12 sequentially engages the cutting edge 26 to sequentially transversely sever the sheet material 12 (see FIG. 4). The teeth defining the cutting edge 26 first pierce the sheet material 12, whereupon further pulling on the dispensed length of sheet material 12 causes the teeth to cut entirely through the sheet material 12.

When all of the sheet material 12 is dispensed, the empty core 36 about which it had been wound can be separated from the dispenser 10 and a new roll 13 of sheet material 12 can be mounted about the collars 38 by manually flexing one or both of the elongate flexible parts 37 of the end walls 22 away from the other, removing the empty core 36, inserting the new roll 13, and then releasing the flexible parts 37 so that the collars 38 enter and journal the core 36 of the new roll 13 of sheet material.

Second Embodiment

Figure 5:
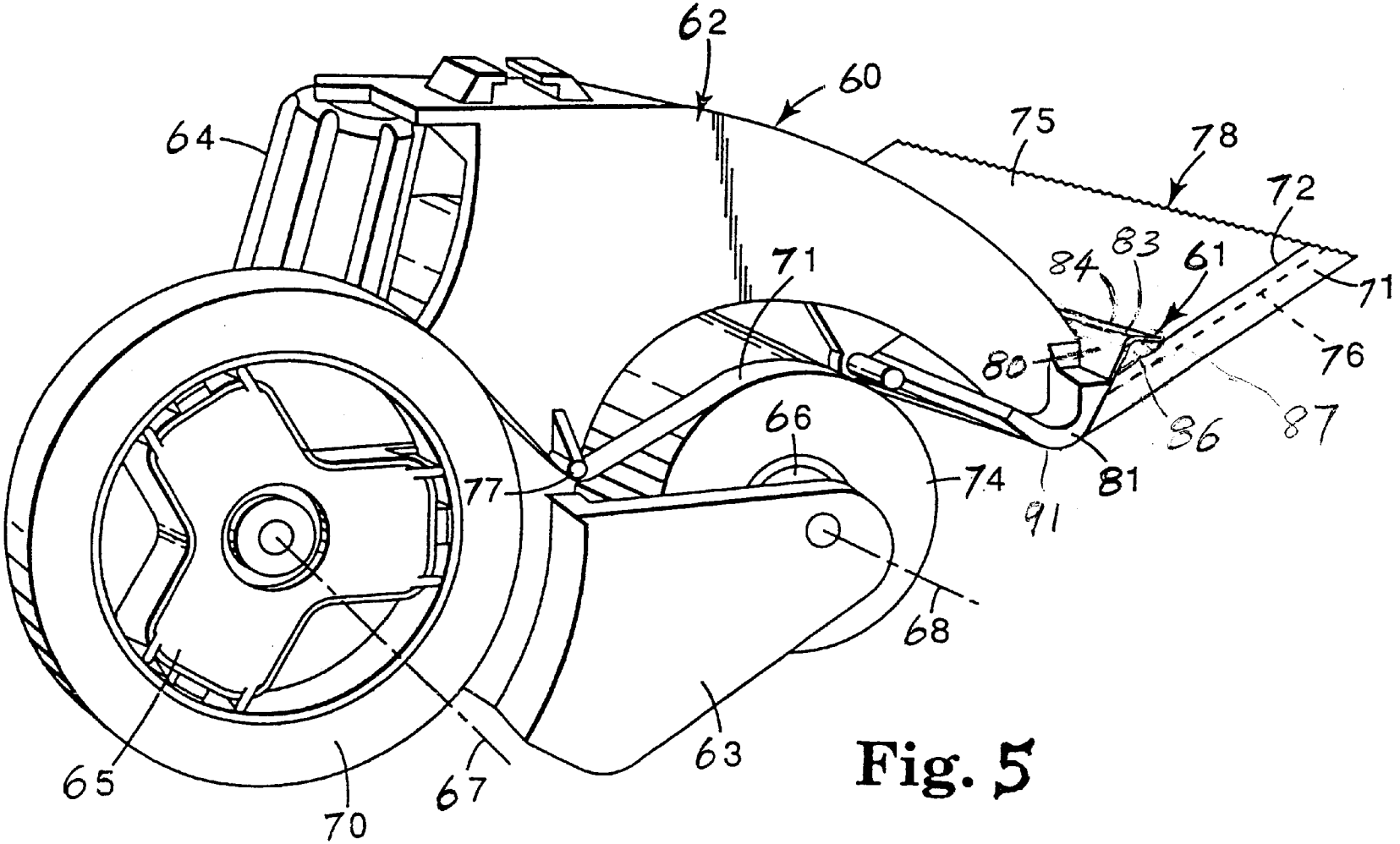
FIG. 5 is a perspective view of a second embodiment of a dispenser including means according to the present invention for protecting users of the dispenser from a cutting edge.
Figure 6:
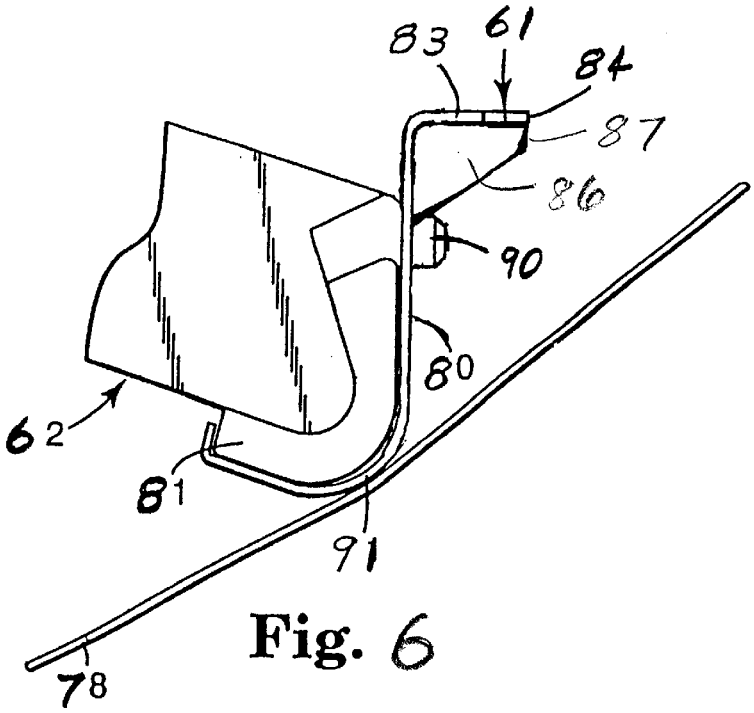
Figure 7:
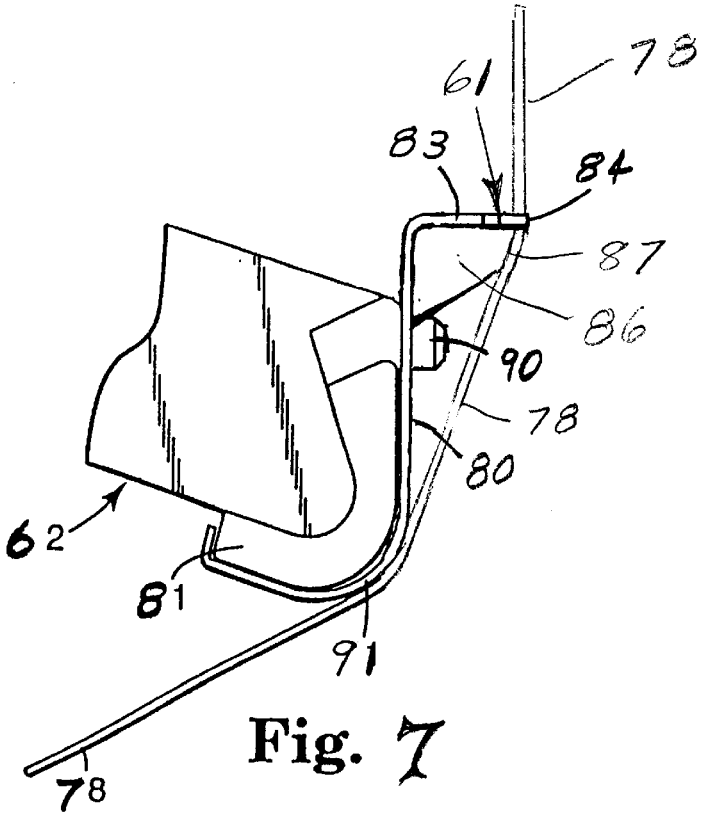

Referring now to FIGS. 5, 6 and 7 of the drawing, there is shown a dispenser 60 including means 61 according to the present invention for protecting users of the dispenser from a cutting edge 84. Most of the dispenser 60 (except for the means 61 for protecting users of the dispenser from the cutting edge 84) is the same as corresponding parts of a dispenser called a masking machine or device that is described in U.S. Pat. No. 4,990,214 (the content whereof is incorporated herein by reference), one embodiment of which is sold my Minnesota Mining and Manufacturing Company, St., Paul, Minn. under the trade designation "HandMasker" (t.m.) M3000 Dispenser. Generally, that dispenser 60 includes a frame 62 comprising a polymeric portion including a hub support frame member 63 and a handle 64 adopted for manual engagement to manipulate the dispenser 60. First and second hubs 65 and 66 are mounted on the hub support frame member 63 for rotation about spaced generally parallel axes 67 and 68. The first hub 65 includes means for receiving a roll 70 of tape 71 and positioning a first edge 72 of a length of the tape 71 withdrawn from the roll 70 at a first predetermined position axially with respect to the first and second hubs 65 and 66 with the opposite second edge of that withdrawn length of tape 71 projecting past the frame 62. The second hub 66 is adapted to receive a roll 74 of masking material 75 and to position a first edge 76 of the length of masking material 75 at a second predetermined position axially with respect to the first and second hubs 65 and 66 with the width of the length of tape 71 extending from the first position past the second position and the width of the length of masking material 75 extending from the second position past the first position. A portion of the length of tape 71 along the first edge 72 of the length of tape and a portion of the length of masking material 75 along the first edge 76 of the length of masking material 75 are both positioned between those first and second positions. The dispenser 60 includes means including a guide pin 77 that defines a path for the length of tape 71 from the roll 70 of tape 71 to the periphery of the roll 74 of masking material 75 where the portion of tape 71 along the first edge 72 of the length of tape 71 is adhered to the portion of the masking material 75 along the first edge 76 of the length of masking material 75. Such adhesion of the tape 71 to the masking material 75 along the periphery of the roll 74 of masking material 75 forms a composite masking sheet material 78 having opposite edges defined by the second edges of the length of tape 71 and the length of masking material 75 and an exposed portion of the coating of pressure sensitive adhesive along the second edge on the length of tape 71 along one major surface of the composite masking sheet material 78 so that the exposed portion of the coating of adhesive can be adhered along a surface to be masked to hold the composite masking sheet 78 in a desired position.

The frame 62 defines a passageway on the device 60 through which a person may pull the composite masking sheet material 78 from the supply of composite masking sheet material 78 formed at the periphery of the roll 74. The frame is formed by members including a first elongate frame member 80 of sheet metal (e.g., 0.018 inch thick steel) that has a generally S-shaped cross section and is removably attached to another member 81 of the frame 62 included in the polymeric part thereof. The first frame member 80 extends generally parallel to the axes 67 and 68 of the hubs 65 and 66 and defines a first side of the passageway. The frame member 80 has a blade portion or blade 83 having the sharp cutting edge 84 adapted for transversely cutting the composite masking sheet material 78. Means in the form of a guard strip 86 of resiliently compressible material is provided for restricting contact between the cutting edge 84 and a person using the dispenser 60. Preferably, a contact surface 87 of the guard strip 86 extends to or just past the cutting edge 84 at the tips of the teeth, and the guard strip 86 is attached by being adhered to portions of the frame member 80 spaced from the cutting edge 84 to facilitate compression of the guard strip 86 when the sheet material 78 is being cut on the blade portion 83. The blade portion 83 is spaced from and extends along the first side of the passageway defined by the first frame member 80. A user of the dispenser 60 can manually tension the composite masking sheet material 78 being pulled from the roll 74 around the blade portion 83 (see FIG. 7) so that the guard strip 86 is sequentially incrementally compressed along its length and the cutting edge 84 of the blade portion 83 intersects and sequentially transversely severs the tensioned composite masking sheet material 78 as that composite masking sheet material 78 is pulled away from the dispenser 60 around the blade portion 83.

The cutting edge 84 can be provided by a plurality of similarly shaped teeth having generally the shapes of triangles along the opposite surfaces of the blade portion 83 of the frame member 80, which teeth have bases aligned in a first direction longitudinally along the blade portion 83 with the points of the teeth projecting in the same direction. Those teeth, which are similar to the teeth described in U.S. Pat. No. 4,913,767 (the content whereof is incorporated herein by reference), can pierce the composite masking sheet material 78 when it is tensioned around the cutting edge 84 so that further tension applied on the composite masking sheet material 78 extending around the cutting edge 84 will cause the teeth to further penetrate the composite masking sheet material 78 as a result of tension being applied to withdraw the composite masking sheet material 78 until the composite masking sheet material 78 is completely severed by the cutting edge 84 that extends along the teeth.

The first sheet metal frame member 80 that includes the blade portion 83 having the cutting edge 84 can be removed from the rest of the dispenser 60 and is removably attached to the frame member 81 by means described in U.S. Pat. No. 4,990,214. That attachment means briefly comprises one side of one end portion of the S-shaped elongate sheet metal frame member 80 being hooked around the member 81 of the polymeric part of the frame 62 that is adapted to fit in that end portion and being retained in that end portion by a pin 90 that projects from the member 81 through an opening in the first frame member 80. The first sheet metal frame member 80 can be removed from the member 81 by manually pressing on the frame member 80 so that it resiliently bends and flexes over the pin 90, whereupon the member 80 can be unhooked from the member 81.

The portion of the first frame member 80 that engages the member 81 of the frame 62 has an arcuate guide surface 91 generally parallel to the sheet material axis 68 that defines the first side of the passageway through which the composite masking sheet material 78 is withdrawn. The blade portion 83 extends along the first side of the passageway defined by the first frame member 80 at a position spaced away from the passageway so that the composite masking sheet material 78 will not normally contact the blade portion 83 as the sheet material 78 is pulled from the dispenser 60. The sheet material 78 must be tensioned in an arcuate path around both the guide surface 91 and the blade portion 83 (see FIG. 7) so that the cutting edge 84 will intersect and sequentially transversely sever masking sheet material 78 being pulled from the dispenser 60. As such severing occurs, the guard strip 86 of resiliently compressible material will be sequentially incrementally compressed along its length to expose the portion of the blade that is sequentially cutting the sheet material 78. Such sequential incremental compression of the guard strip 86 does not require a large force because it only occurs over a rather short length of the guard strip 86 of resiliently compressible material. The guard strip 86 of resiliently compressible material will provide significant resistance to compression and exposure of the cutting edge 84 of the blade portion 83 when the guard strip 86 is contacted by the relatively wide surfaces of a users fingers or hand, however, thereby restricting seriously injurious contact with the cutting edge 84 of the blade portion 83.

The guard strip 86 can have a uniform cross section of a resiliently compressible material (e.g., open or closed cell urethane foam) shaped to provide a desired resistive force profile as the guard strip 86 is compressed (e.g., a contact surface 87 about 0.09 inch or 0.24 centimeter wide at the tips of the teeth, with one side surface at right angle to that contact surface 87 and the other side surface diverging from that contact surface 87 at an angle of about 45 degrees as is illustrated in FIGS. 6 and 7).

Figure 8:
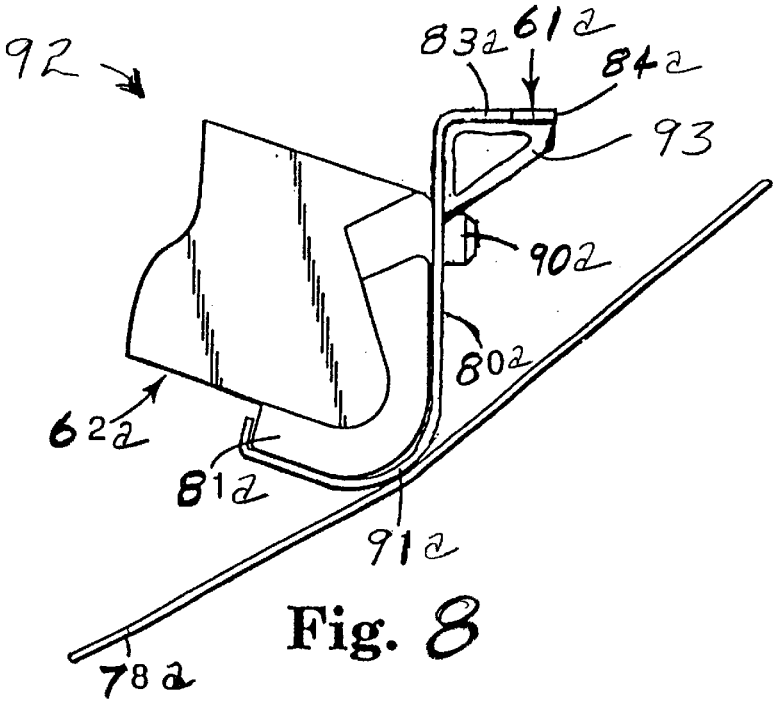
FIG. 8 is an enlarged fragmentary view of a dispenser similar to the dispenser of FIG. 5 that includes a third embodiment of means according to the present invention for protecting users of the dispenser from a cutting edge.

FIG. 8 illustrates a dispenser 92 including a third embodiment of means according to the present invention for protecting users of the dispenser from a cutting edge 84*a*. The dispenser 92 has structural features or elements that are the same as the structural features or elements of the dispenser 60 illustrated in FIGS. 5 through 7 which are identified with the same reference numeral to which has been added the suffix "a". The dispenser 92 differs from the dispenser 60 only in that instead of the guard strip 86, a guard strip 93 of resiliently compressible material is used that is a shaped hollow tube of polymeric material, with the walls of the guard tube or strip 93 shaped and having thicknesses that provide a desired resistive force profile as the guard strip 93 is compressed Such a shaped hollow tube could also be used in place of the guard strip 30 of resiliently compressible material described above with reference to FIGS. 1, 2, 3, and 4 for use in the dispenser 10.

Figure 9:
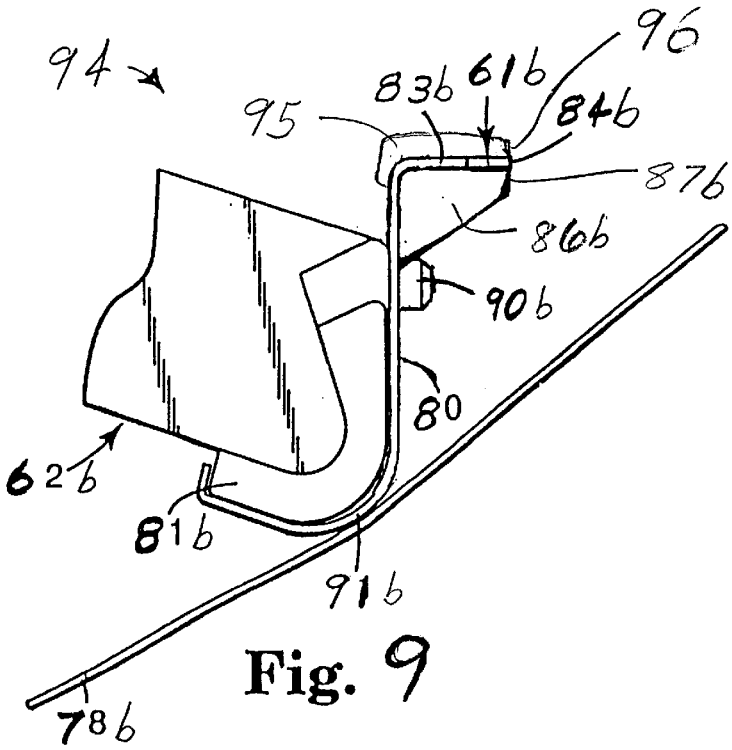
FIG. 9 is an enlarged fragmentary view of a dispenser similar to the dispenser of FIG. 5 that includes a fourth embodiment of means according to the present invention for protecting users of the dispenser from a cutting edge.

FIG. 9 illustrates a dispenser 94 including a fourth embodiment of means according to the present invention for protecting users of the dispenser from a cutting edge 84*b*. The dispenser 94 has structural features or elements that are the same as the structural features or elements of the dispenser 60 illustrated in FIGS. 5 through 7 which are identified with the same reference numeral to which has been added the suffix "b". The dispenser 94 differs from the dispenser 60 only in that a second guard strip 95 of resiliently compressible material having a second contact surface 96 along the cutting edge 84*b* is provided on the side of the blade portion 83*b* opposite the guard strip 86*b*. The second guard strip 95 could either have a uniform cross section as illustrated or could be a shaped hollow tube to provide, with the guard strip 86*b*, a desired resistive force profile as the guard strips 86*b* and 95 are compressed. A similar second guard strip could also be used on the side of the blade 24 opposite the guard strip 30 for the dispenser 10 described above.

Figure 10:
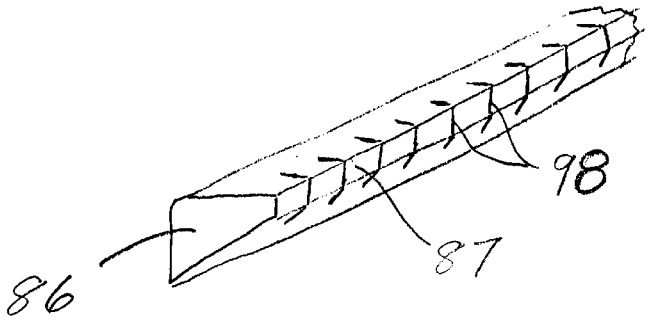
FIG. 10 is a perspective view of a guard strip for a cutting blade of the dispenser of FIG. 5 which is modified by having spaced slits along one surface.

Any of the guard strips 30, 86, 93, or 95 of resiliently compressible material described above might also advantageously have spaced slits or slots through their contact surface 31, 87, 87*b*, or 96 that normally extends along the cutting edge 26, 84, 84*a* or 84*b* (e.g., slits to a depth of about 40 to 80 percent of the cross sectional area of the guard strips 30, 86, 93, or 95 spaced at about 0.1 inch or 0.25 cm). Such slits or slots facilitate localized compression of the guard strips 30, 82 93, or 95 with less force than would be required to compress un-slit or slotted guard strips 30, 86, 93 or 95 as the sheet material is transversely cut along the cutting edge 26, 84, 94*a* or 84*b*. Such spaced slits or slots 98 in the guard strip 86 are illustrated in FIG. 10 where a fragment of the guard strip 86 is shown separated from the rest of the dispenser 60. As an alternative to slits or slots, elongate sockets or recesses opening through the contact surface 31, 87, 87*b*, or 96 could be formed in the guard strips 30, 86, 93, or 95 to facilitate localized compression of the guard strips 30, 82 93, or 95 with less force than would be required to compress guard strips 30, 86, 93 or 95 without such sockets or recesses as the sheet material is transversely cut along the cutting edge 26, 84, 94*a* or 84*b*.

Figure 11:
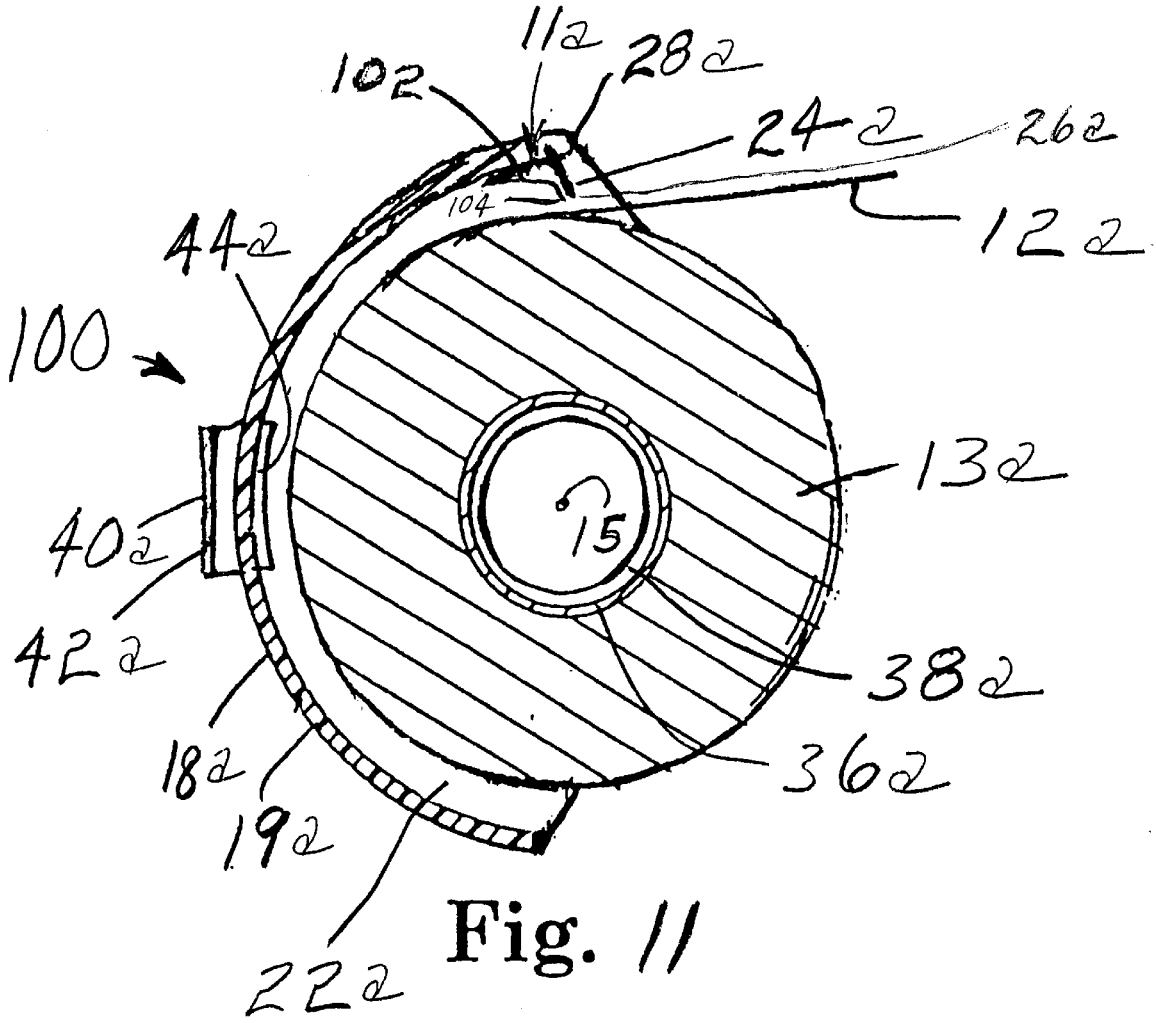
FIG. 11 is a sectional view of a dispenser similar to the dispenser of FIG. 1 that includes a fifth embodiment of means according to the present invention for protecting users of the dispenser from a cutting edge.
Figure 1:
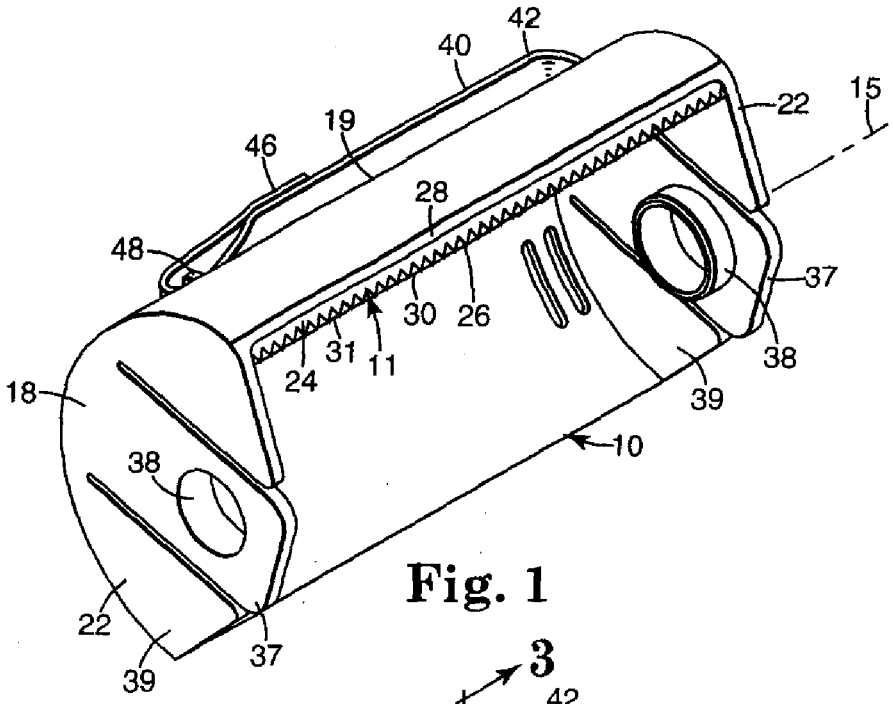
Figure 2:
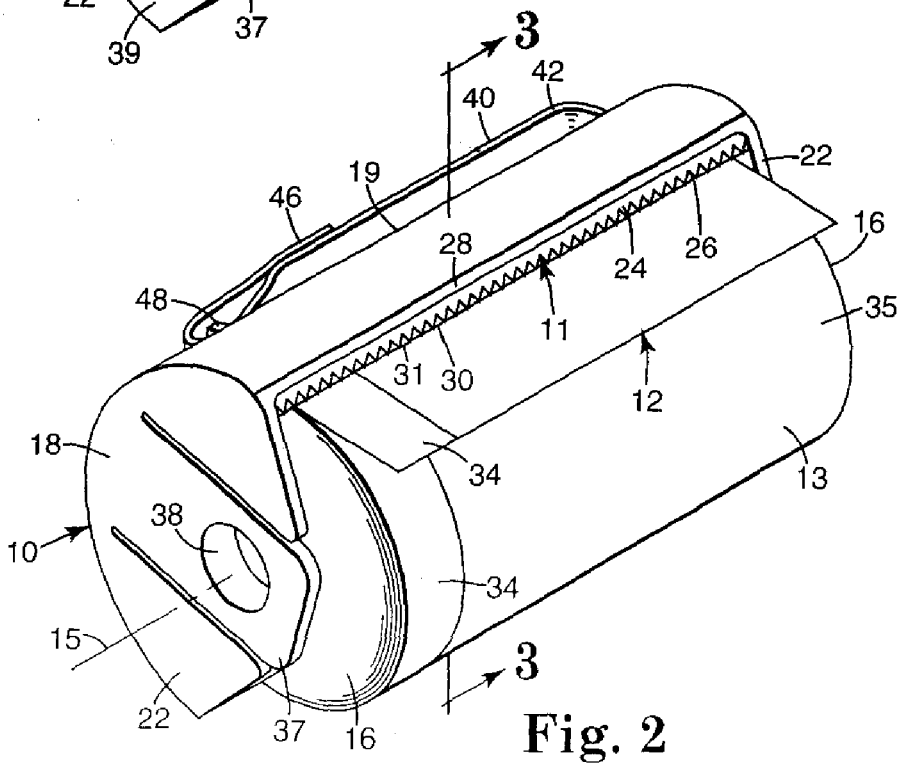
Figure 3:
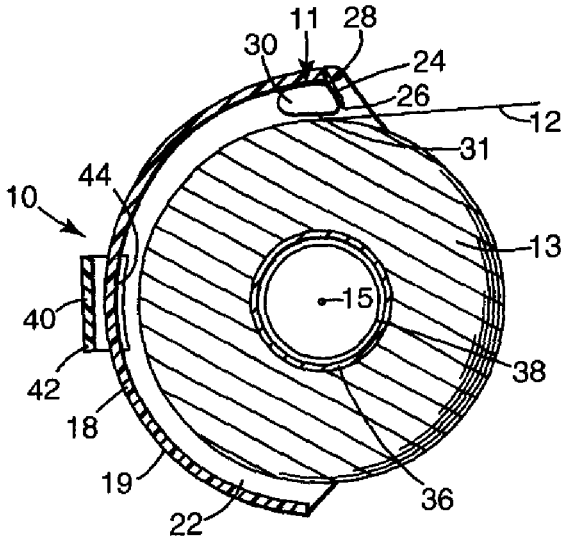
Figure 4:
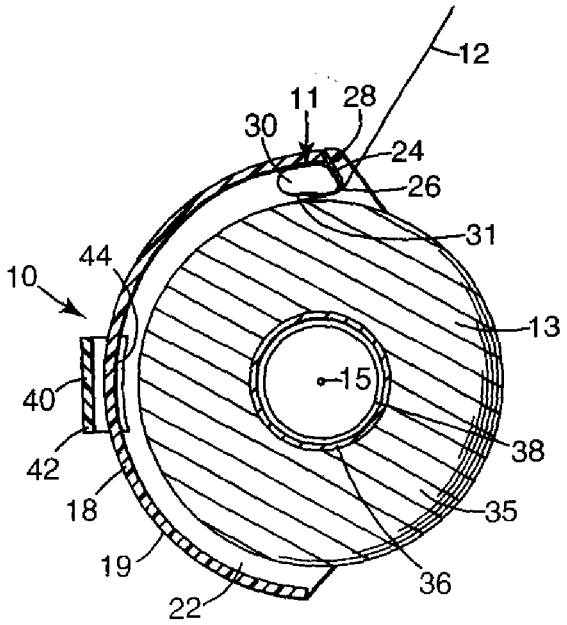
Figure 5:
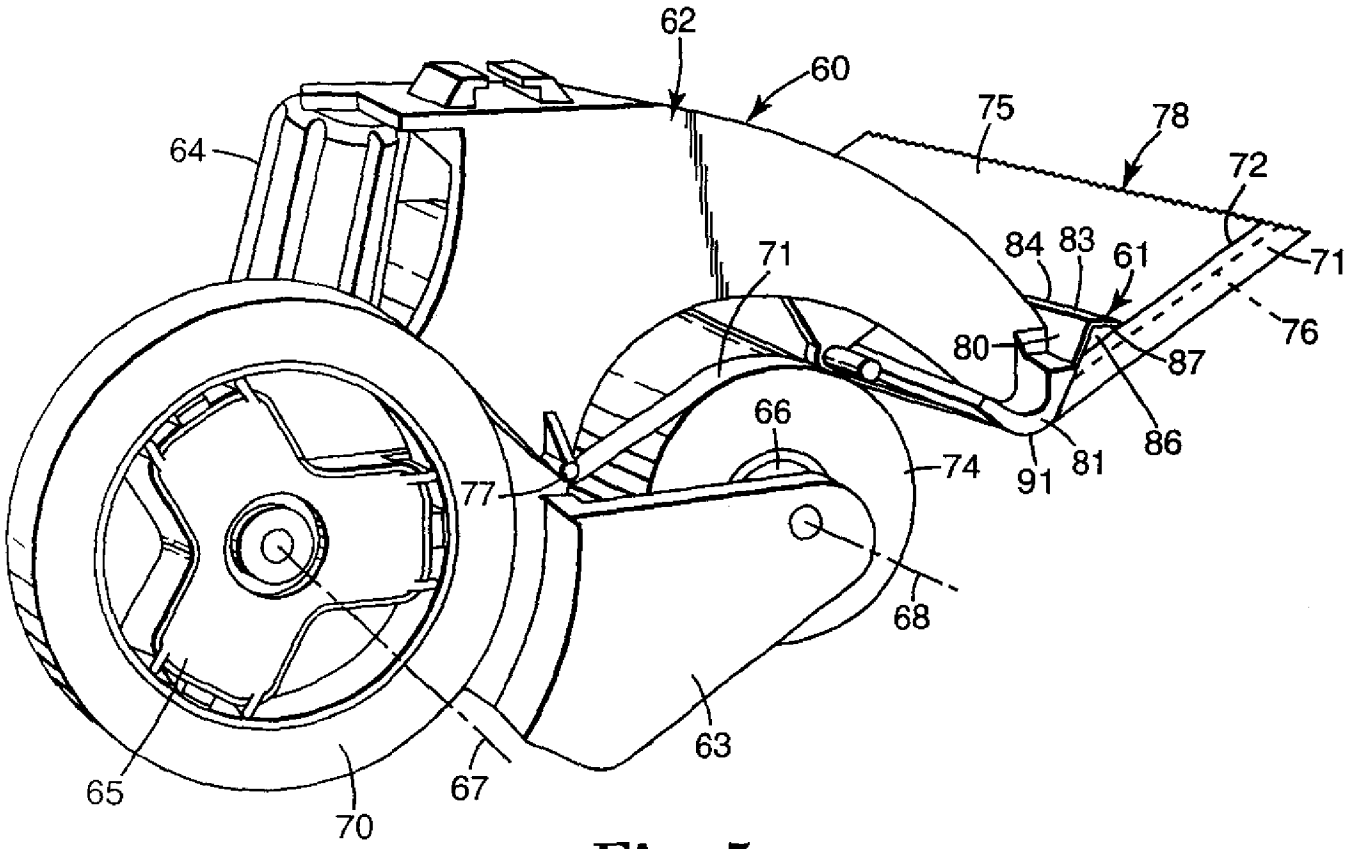
Figure 6:
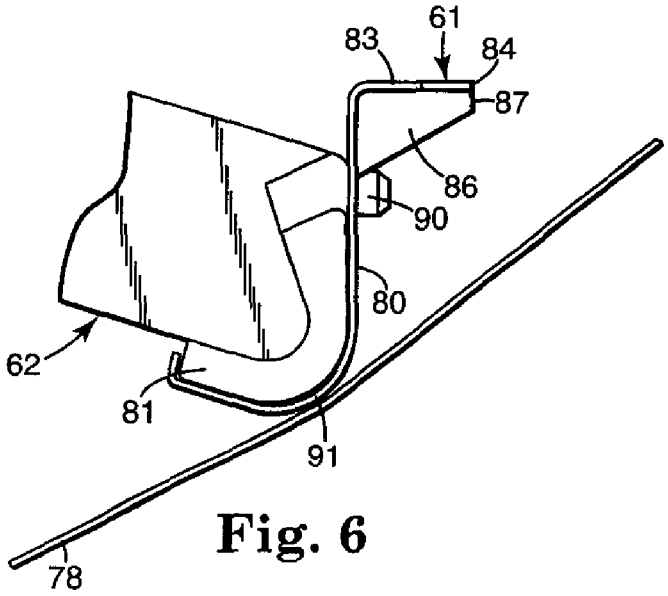
Figure 7:
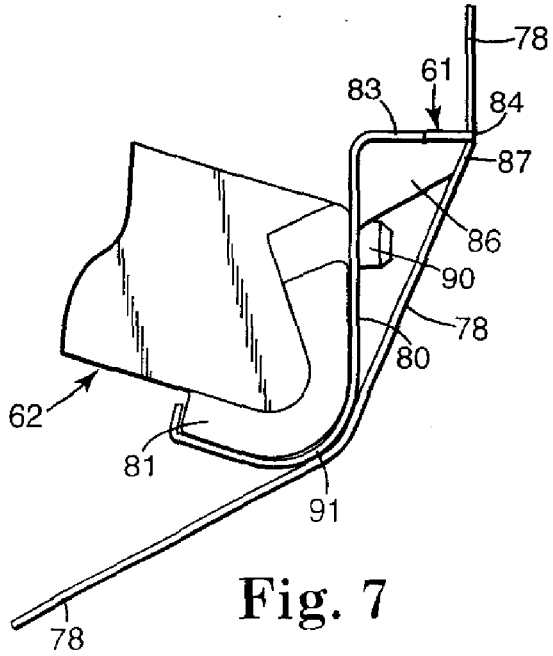
Figure 8:
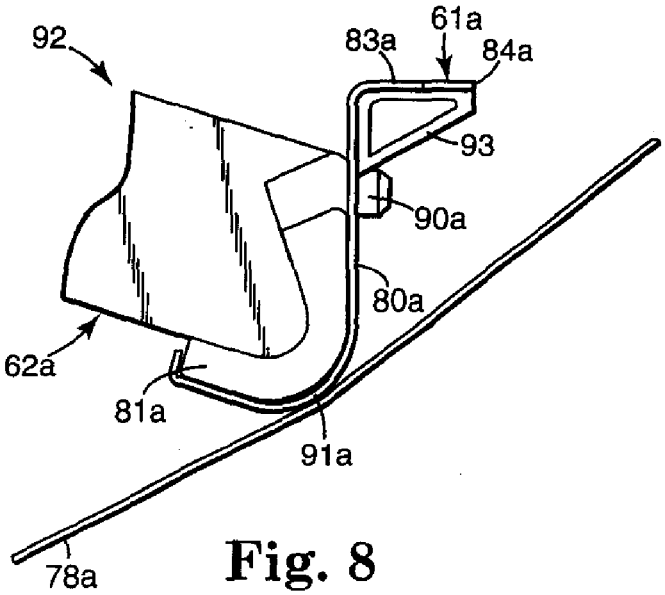
Figure 9:
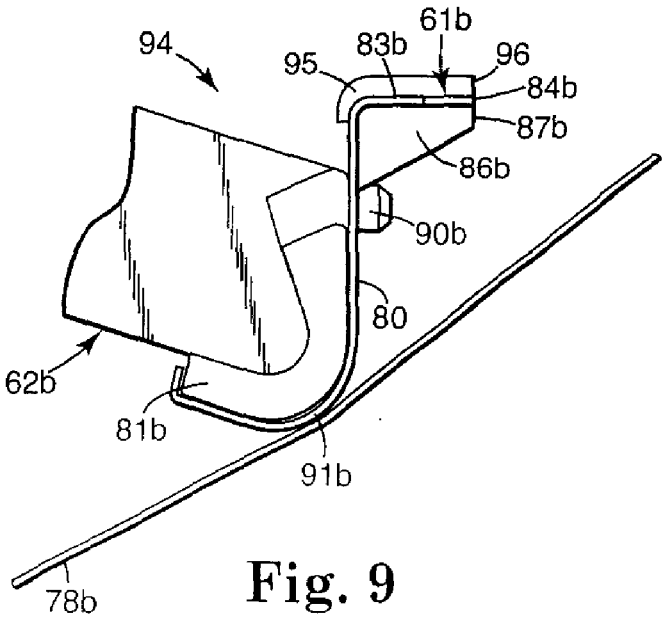
Figure 10:
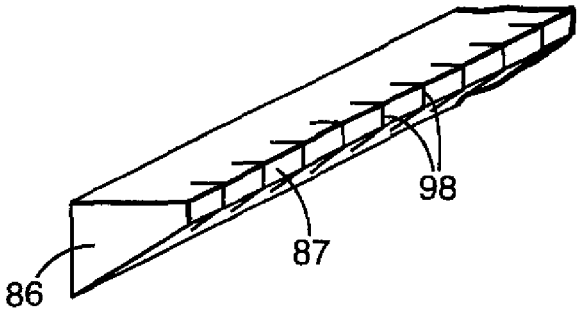
Figure 11:
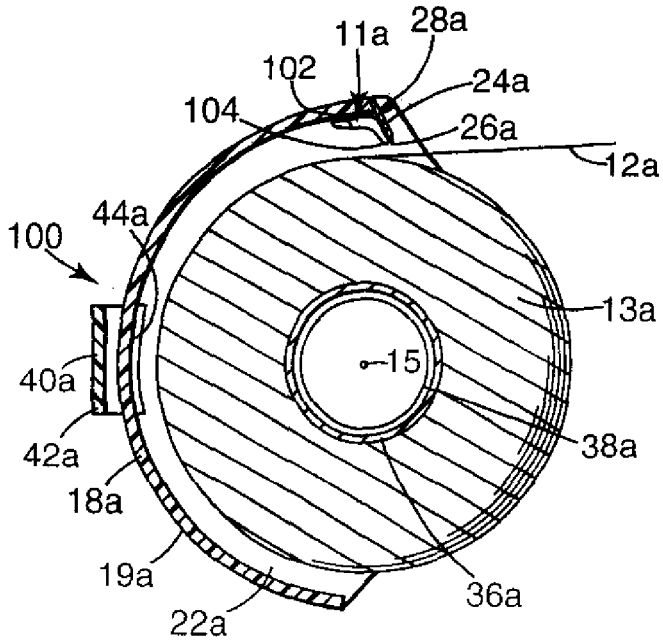

FIG. 11 illustrates a dispenser 100 including a fifth embodiment of means according to the present invention for protecting users of the dispenser from a cutting edge 26*a*. The dispenser 100 has structural features or elements that are the same as the structural features or elements of the dispenser 10 illustrated in FIGS. 1 through 4 which are identified with the same reference numeral to which has been added the suffix "a". The dispenser 100 differs from the dispenser 10 only in that a generally L-shaped guard strip 102 of resiliently movable or flexible material (e.g., 0.02 inch or 0.05 cm thick polyester or a thin strip of brass or stainless steel) is used in place of the guard strip 30 of compressible material along the major surface of the blade 24*a* adjacent the major part of the bridging portion 19*a*. A contact surface 104 of the guard strip 102 is positioned at and along the tips of the teeth to restrict contact between sheet material 12*a* being pulled from the roll 13*a* and the cutting edge 26*a*. The guard strip 102 can be resiliently moved by pulling the side of the sheet material 12*a* toward the cutting edge 26*a* to allow the cutting edge 26*a* to transversely sever the sheet material 12*a* being pulled from the roll 13*a*. Preferably, the contact surface 104 of the guard strip 102 normally extends to or just past the cutting edge 26*a* at the tips of the teeth, and the guard strip 102 is attached by having a portion opposite the contact surface 104 adhered to the frame 18*a* to facilitate movement of the guard strip 102 when the sheet material 12*a* is being cut on the blade 24*a*. Contact between a user of the dispenser 10*a* and the cutting edge 26*a* on the teeth is primarily restricted because the ends of the teeth are directed inwardly toward the roll 13*a*, however after sufficient sheet material 12*a* is removed from the roll 13*a* that there is sufficient space between the roll 13*a* and the cutting edge 26*a* for the users fingers, the contact surface 104 of the guard strip 102 adjacent the tips of the teeth can also provide a measure of protection for the user. The guard strip 102 could also advantageously have spaced slits through its contact surface 104 that normally extends along the cutting edge 26*a* (similar to those illustrated in FIG. 10) to facilitate localized compression of the guard strip 102 with less force as the sheet material 12*a* is cut along the cutting edge 26*a*.

The present invention has now been described with reference to several embodiments and modifications thereof. It will be apparent to those skilled in the art that many changes can be made in the embodiments described without departing from the scope of the present invention. For example, the cutting edge 26 or 84 can be formed on spaced teeth as described above, or alternatively could be any other cutting edge, such as a straight sharp cutting edge of the type used on a razor blade. Also, the cutting edge 26 can be formed on a metal blade 24 as described above, or, for easily cut materials, could be formed along the edge of the bridging portion 19. Thus, the scope of the present invention should not be limited to the structures and methods described in this application, but only by the structures and method described by the language of the claims and the equivalents thereof.

What is claimed is:

1. A portable dispenser from which sheet material may be dispensed from a supply of the sheet material in a roll having an axis and axially spaced end surfaces, said dispenser comprising:

a frame including a bridging portion having opposite ends and an edge extending between said ends, said bridging portion being adapted to extend along a portion of the periphery of the roll to position said ends at the end surfaces of the roll, said frame further including end wall portions fixed to the ends of said bridging portion and adapted to extend along the opposite end surfaces of the roll of sheet material;

said dispenser including means for journaling the roll of sheet material for rotation about the axis of the roll on said end wall portions to position the end surfaces of the roll adjacent said end walls with said bridging portion extending along the periphery of the roll;

an elongate blade having opposite major surfaces extending between opposite first and second elongate edges of the blade, with a portion of said blade defining a sharp cutting edge along said first elongate edge of the blade adapted for transversely cutting the sheet material, said blade being fixed to said bridging portion of the frame adjacent said edge of the bridging portion with said cutting edge transverse to said path and with a major part of said bridging portion on the side of said blade opposite said edge of the bridging portion, with said portion of said blade defining said cutting edge adjacent the axis of the roll, and with the major surface of said blade adjacent said major part of said bridging portion disposed at an angle of more than about 110 degrees with respect to a plane passing through the axis of the roll and generally through said cutting edge to restrict contact with said cutting edge by a person using the dispenser; and a strip of resiliently compressible material extending along the major surface of said blade adjacent said major part of said bridging portion, said strip of resiliently compressible material having a contact surface normally extending along said sharp cutting edge, and said strip being resiliently compressible by pulling said sheet material toward said cutting edge to allow said cutting edge to transversely sever the sheet material being dispensed from the dispenser.

2. A dispenser according to claim 1 wherein said major surface of said blade adjacent the major part of said bridging portion is disposed at an angle of about 135 degrees with respect to a plane passing through said axis and generally through said cutting edge of said blade.

3. A dispenser according to claim 1 wherein said blade includes generally triangular teeth along said first edge with said cutting edge being along said teeth, and said strip of resiliently compressible material is separated from said blade along said teeth.

4. A dispenser according to claim 1 in combination with the sheet material, wherein said sheet material is a composite of adhesive coated tape and longitudinally folded polymeric film.

* * * * *

UNITED STATES PATENT AND TRADEMARK OFFICE

CERTIFICATE OF CORRECTION

PATENT NO. : 6,786,376 B1
DATED : September 7, 2004
INVENTOR(S) : Pitzen, James F.

It is certified that error appears in the above-identified patent and that said Letters Patent is hereby corrected as shown below:

Title page,
Item [56], References Cited, U.S. PATENT DOCUMENTS, please add the following reference:

| | | |
|---|---|---|
| -- 4,913,767 | 04/1990 | Longworth |
| 4,990,214 | 02/1991 | Heil et al. -- |

FOREIGN PATENT DOCUMENTS, please add the following references:

| | |
|---|---|
| -- WO | 98/51603 |
| WO | 99/49804 -- |

Drawings,
Sheet 1 of 6 thru Sheet 6 of 6, delete informal drawings Figs. 1-11 and replace with the attached formal drawings Figs. 1-11

Column 9,
Line 8, after the number "82" insert -- , --
Line 18, after the number "82" insert -- , --

Signed and Sealed this

Nineteenth Day of July, 2005

JON W. DUDAS
*Director of the United States Patent and Trademark Office*

(12) United States Patent
Pitzen et al.

(10) Patent No.: US 6,786,376 B1
(45) Date of Patent: Sep. 7, 2004

(54) ROLLED SHEET MATERIAL DISPENSER WITH PROTECTED SHEET CUTTING MEANS

(75) Inventors: James F. Pitzen, Maplewood, MN (US); Ronald C. Johansson, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/571,590

(22) Filed: May 17, 2000

(51) Int. Cl.[7] ..... B26F 3/02
(52) U.S. Cl. ..... 225/19; 225/56; 225/77
(58) Field of Search ..... 225/19, 20, 48, 225/56, 77, 91, 93; 83/568, 570, 649; 242/522, 523.1, 526, 554.2

(56) References Cited

U.S. PATENT DOCUMENTS

| | | | | | |
|---|---|---|---|---|---|
| 2,125,736 | A | | 8/1938 | Murray | |
| 2,229,961 | A | * | 1/1941 | Deane | 225/19 |
| 3,227,340 | A | * | 1/1966 | Haley | 225/19 |
| 3,419,201 | A | * | 12/1968 | Brandon | 83/649 |
| 3,552,614 | A | * | 1/1971 | Wilson et al. | 225/20 |
| 3,565,307 | A | * | 2/1971 | Wiley et al. | 225/19 |
| 3,739,964 | A | * | 6/1973 | Stine | 225/53 |
| 4,651,911 | A | * | 3/1987 | Kirkup et al. | 225/20 |
| 4,781,316 | A | * | 11/1988 | Freeberg | 225/91 |
| 4,972,984 | A | * | 11/1990 | Frank et al. | 225/20 |
| 4,989,769 | A | * | 2/1991 | Longworth et al. | 225/20 |
| 5,054,675 | A | * | 10/1991 | Taves | 225/20 |
| 5,222,644 | A | * | 6/1993 | Moreno | 225/19 |
| 5,383,590 | A | * | 1/1995 | Ho | 225/87 |
| 5,928,466 | A | · | 7/1999 | Yu Chen | |
| 6,039,102 | A | * | 3/2000 | Sadrakula et al. | 225/20 |
| 6,296,033 | B1 | * | 10/2001 | Clements | 225/19 |

FOREIGN PATENT DOCUMENTS

| | | |
|---|---|---|
| EP | 0 714 845 A1 | 6/1996 |

* cited by examiner

*Primary Examiner*—Stephen Choi
(74) *Attorney, Agent, or Firm*—William L. Huebsch

(57) ABSTRACT

A dispenser from which sheet material may be dispensed from a supply of the sheet material carried on the dispenser. The dispenser has a frame on which the roll of sheet material is journaled for rotation about its axis. An elongate blade fixed to the frame has a sharp cutting edge that is adapted for transversely cutting the sheet material after a desired length of the sheet material has been dispensed. A guard strip of resiliently movable material extends along one major surface of the blade and along the cutting edge to help protect the sheet material and/or users of the dispenser from the cutting edge. That guard strip is resiliently movable by pulling the sheet material toward the cutting edge to allow the cutting edge to transversely sever the sheet material being pulled from the dispenser.

4 Claims, 6 Drawing Sheets

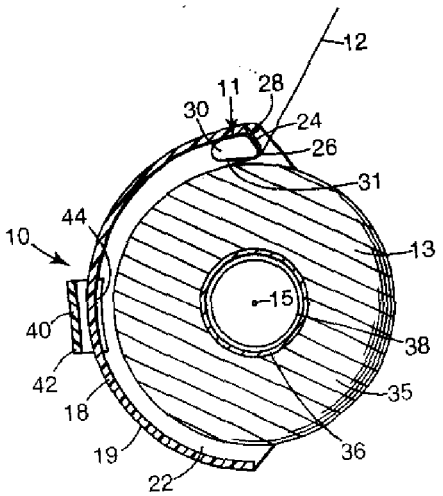

Fig. 4